United States Patent [19]

Piesik

[11] 4,404,887

[45] Sep. 20, 1983

[54] RECOIL REDUCER

[75] Inventor: Edward T. Piesik, Pomona, Calif.

[73] Assignee: General Dynamics, Pomona Division, Pomona, Calif.

[21] Appl. No.: 385,520

[22] Filed: Jun. 7, 1982

Related U.S. Application Data

[63] Continuation of Ser. No. 162,291, Jun. 23, 1980, abandoned.

[51] Int. Cl.[3] ..... F41F 3/04

[52] U.S. Cl. ..... 89/1.816; 89/1.703; 89/14 C

[58] Field of Search ..... 89/1.816, 1.8, 1.7, 89/1.817, 1.819, 1.703, 1.704, 1.705, 14 C

[56] References Cited

U.S. PATENT DOCUMENTS

| | | | |
|---|---|---|---|
| 2,457,802 | 1/1949 | Bauer | 89/14 C |
| 2,925,014 | 2/1960 | Abramson | 89/1.703 |
| 2,949,061 | 8/1960 | Benditt et al. | 89/1.7 |
| 3,030,865 | 4/1962 | Ridnour | 89/1.816 |
| 3,146,669 | 9/1964 | Wolf | 89/1.816 |
| 3,215,041 | 11/1965 | Dietsch et al. | 89/1.7 |
| 3,302,522 | 2/1967 | Laureys | 89/1.816 |
| 3,446,111 | 5/1969 | Dardick | 89/1.7 |
| 3,495,497 | 2/1970 | Stangl et al. | 89/1.816 X |
| 3,610,093 | 10/1971 | Mebus | 89/1.7 |
| 3,999,460 | 12/1976 | Skliris | 89/1.816 X |
| 4,151,780 | 5/1979 | Andersson | 89/1.7 |

FOREIGN PATENT DOCUMENTS

| | | | |
|---|---|---|---|
| 1801614 | 6/1970 | Fed. Rep. of Germany | 89/1.816 |
| 89970 | 8/1937 | Sweden | 89/1.816 |
| 170178 | 1/1960 | Sweden | 89/1.816 |
| 759350 | 10/1956 | United Kingdom | 89/1.816 |

*Primary Examiner*—David H. Brown

*Attorney, Agent, or Firm*—Neil F. Martin; John R. Lindsay; Edward B. Johnson

[57] ABSTRACT

A missile launcher tube from which a missile is fired from a forward end causing gases to exit out the aft, or exhaust gas, end of a launcher tube in which the aft end is provided with a conical surface (flare) forming a nozzle so that as the missile exits from the forward end, a forward pressure force created by the exhaust gas acting on the conical surface as the exhaust gas exits from the aft end opposes and reduces an aft end directed recoil force. The conical nozzle is located entirely within the outer surface of the launcher tube so that the launcher tube envelope is not disturbed.

2 Claims, 4 Drawing Figures

RECOIL REDUCER

The Government has rights to this invention pursuant to contract No. DAAK40-72-C-0773 awarded by the U.S. Army.

This is a continuation of application Ser. No. 162,291 filed June 23, 1980, now abandoned.

BACKGROUND OF THE INVENTION

The present invention relates to launcher tubes for missiles and particularly to a means for reducing the recoil force exerted on the launcher tube by gases from the missile as the missile exits from the launcher tube.

When the rocket type missile is fired from a launcher tube, the missile exhaust gases are pressurized within the tube and impose a viscous drag on the inside wall of the tube while flowing and exhausting out the exit end of the tube causing the launcher tube to tend to move aft. This aft motion of the launcher tube is indicative of a recoil impulse (force multiplied by time) which is imparted to the rocket supporting means, whether an individual or a mechanical device supporting the launcher tube, during firing. Such an impulse could cause injury to the indivudual or damage to the launching mechanism.

It can be seen that it is therefore desirable to reduce this exhaust gas recoil force and this is the primary object of this invention.

It is also quite advantageous to be able to reduce this recoil force in a simple manner and particularly to be able to do this without disturbing the integrity of the envelope design (outer surface) and/or aft end attachments, such as handling bumpers, aft cover retainers, etc.

It is well known that the forward force on a nozzle is obtained from the static pressure acting on the nozzle walls minus the ambient pressure and multiplying this quantity by the forward projected area of the nozzle.

Thus, another object of this invention is to reduce the recoil force of a launcher tube in a manner that is simple and which does not destroy the integrity of the envelope design.

SUMMARY OF THE INVENTION

The invention which accomplishes the above objects comprises the provision of a conical surface (flare) which extends from the outside wall envelope of the launcher tube to the inside wall or surface of a launcher tube which conical surface is subjected to the exiting exhaust gases as the rocket is fired from the launcher tube to produce a pressure force in the direction of the forward end of the launcher tube opposing the recoil force caused by the pressurized gases of the missile exhaust dragging the tube toward the aft end.

The conical nozzle of this invention does not extend beyond the outer wall (envelope) of the launcher tube (or aft end attachements) and is characterized by the simplicity in the manner in which the reduction of the recoil force is accomplished.

BRIEF DESCRIPTION OF THE DRAWINGS

The above and other advantages of the present invention will become apparent from the following description when read in conjunction with the drawings, wherein.

DETAILED DESCRIPTION OF THE INVENTION

Figure 1:
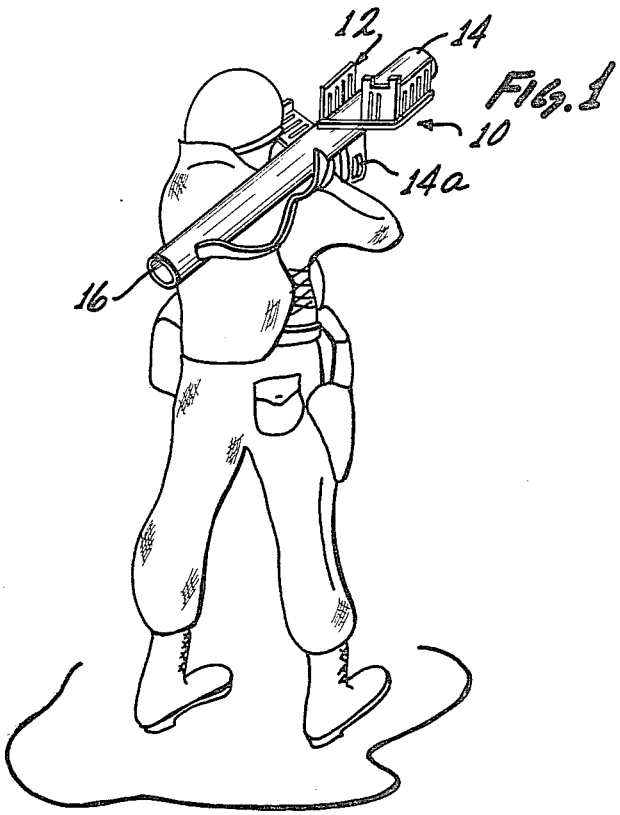
FIG. 1 illustrates a shoulder fired launcher tube with the aft end of the tube shown as having the present invention embodied therein.
Figure 2:
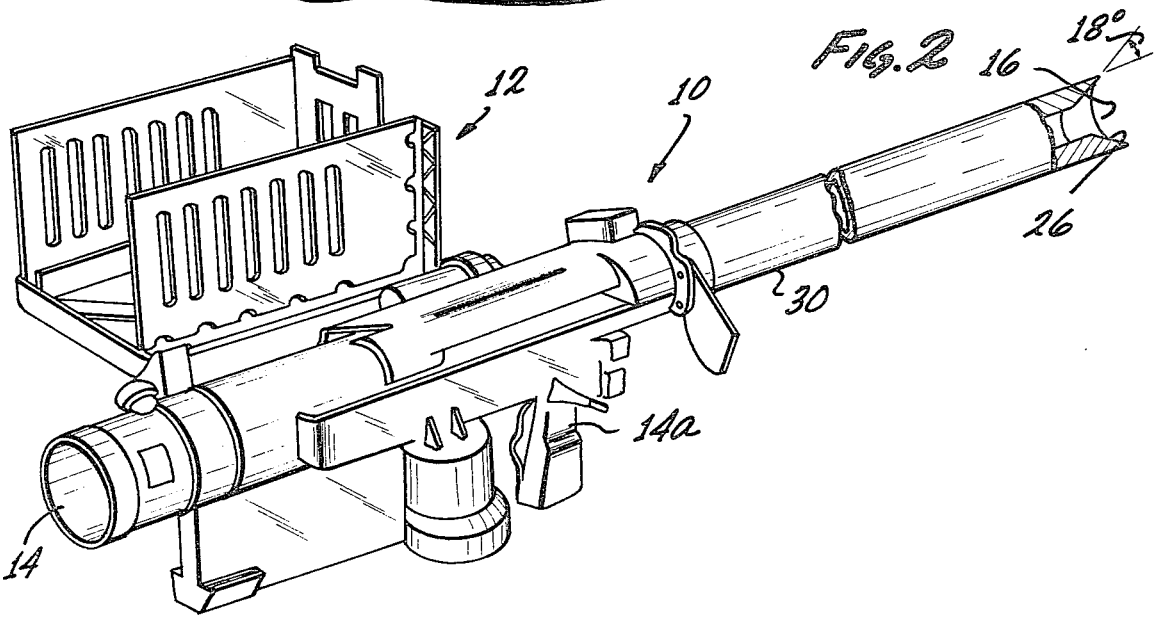
FIG. 2 is a perspective view of a shoulder fired launcher tube enlarged over FIG. 1 to show the details of such a launcher tube and partially broken away at the aft end to illustrate the invention embodied therein.

Turning now to the drawings particularly FIGS. 1 and 2, there is illustrated a shoulder fired cylindrical launcher tube 10 illustrated in FIG. 1 in firing position and being aimed and fired through the use of a suitable aiming means 12 and trigger firing means 14*a*. The fired missile will emerge from the forward end 14 while exhaust gases will flow out the aft end 16. It is to be understood before going further in description that, while this invention is shown embodied in a shoulder fired launcher tube, the invention applies equally well to launcher tubes having mechanical supporting devices. Too, as shown more clearly in FIGS. 2 and 3, the aft end has been simplified for the purposes of disclosure by the removal of a portion of the aft cover assembly normally used in launcher tubes of this type.

Figure 3:
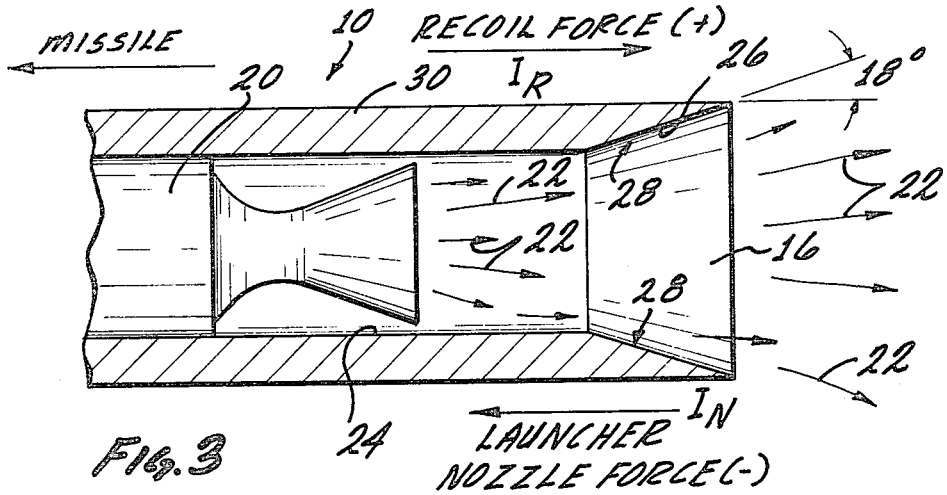
FIG. 3 is a cross sectional view of a missile launcher tube in its simplest form illustrating a missile exiting from the tube with the exhaust gases exiting from the aft end with its conical nozzle formed therein.

Turning now particularly to FIG. 3, typically, when a rocket, such as 20 (only a portion being shown) is fired from the launcher tube, the missile exhaust gases illustrated by arrows 22, pressurize the inside wall 24 of the tube with an internal static pressure which is greater than ambient pressure and cause a viscous drag on the inside wall dragging the launcher tube to the rear (aft) as the missile moves forward out the front end. This aft motion of the launcher tube is a recoil impulse $I_R$ (force times TIME, and is imparted to the individual such as shown in FIG. 1 or to a mechanical supporting device supporting the launcher tube.

This recoil impulse can be considerable and could cause injury to the individual firing the missile or could cause damage to the device which supports the launcher tube is a mechanical device is used.

To reduce the recoil impulse of the launcher tube, the aft end is provided with a flare or conical surface 26, which forms a nozzle and which is reacted upon by the pressurized gases as they expand along the flared conical nozzle as they exit from the aft end as illustrated by arrows 28. These gases impart a forward nozzle impulse $I_N$ acting in the direction of the forward end of the tube and oppose the rearward acting recoil impulse $I_R$ to reduce the latter impulse measurable.

An important aspect to this invention is the fact that a conical surface is provided, or formed, within the confines of the outer envelope or outer surface 30 of the launcher tube and the inner side wall 24 of the launcher tube thus terminating between the outer surface and the inside wall, as a simple way of providing this reduced recoil without the need for a change in the overall configuration of the launch tube envelope. Thus this invention does not violate the envelope design of the tube, the design of which is determined by other factors and should not be changed.

It is noted that, if the launcher was a bare tube, and the tube wall was very thin, little effect could be obtained since little forward projected area is available for the nozzle pressure to act on. In this case an effective design would have to violate the envelope.

Figure 4:
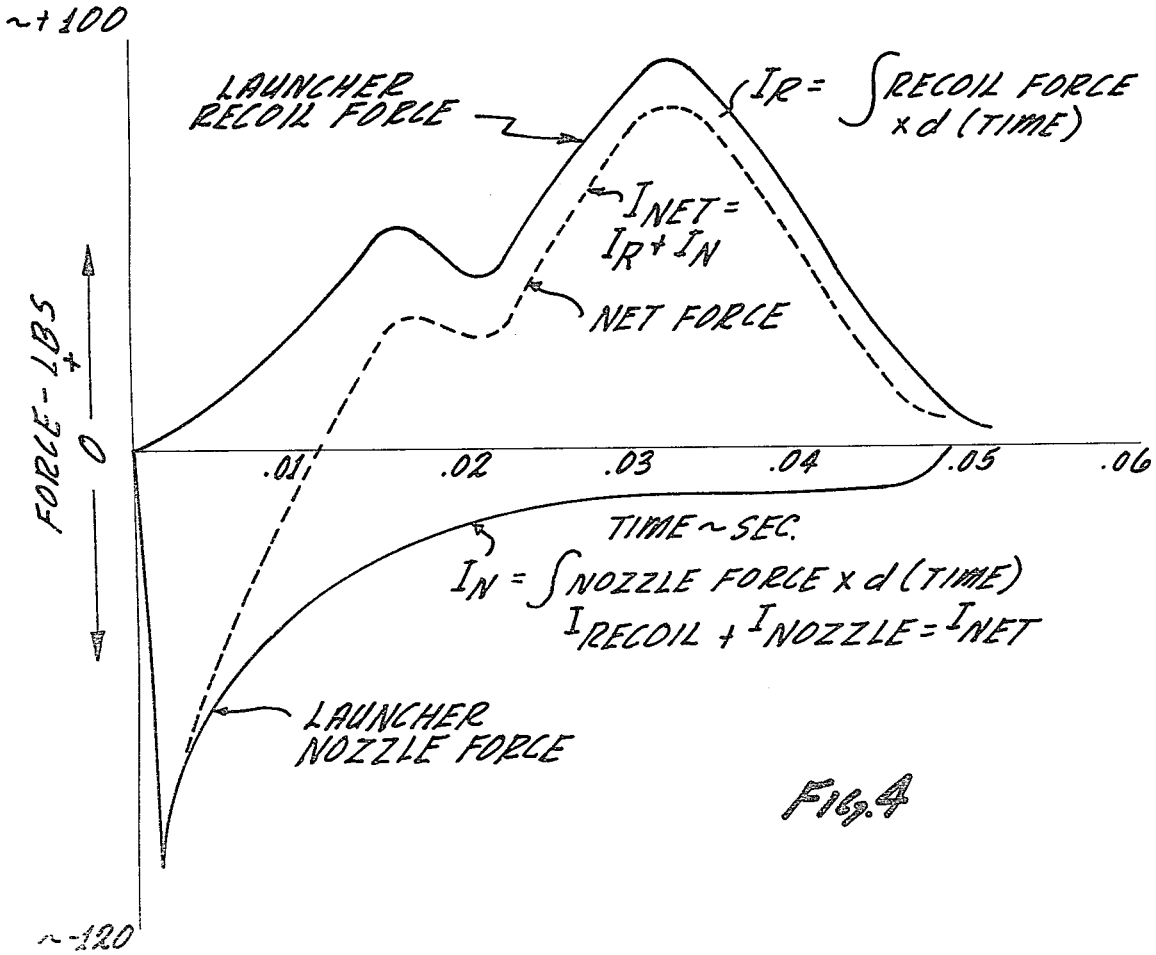
FIG. 4 is a graph showing forces (Y direction) versus time (X direction) involved in firing a missile from a launcher tube and showing the reduction in the recoil impulse (net impulse) due to the incorporation of this invention in a launcher tube.

FIG. 4 is a graph showing a force (Y direction) versus time (X direction) and recoil impulse $I_R$ distribution for an existing launcher tube as represented by the area under the curve $I_R$. This launcher nozzle impulse $I_N$ opposes and provides a net recoil impulse $I_{NET}$ which is considerably less as shown in this graph by the incorporation of the present invention. These curves are generated utilizing an existing launcher tube which was provided with a conical surface with an 18° half angle relative to the outside surface of the launcher tube (see FIG. 3). The angularity of the half angle of the conical surface can vary as is well known, from about 10° to about 20° but the curves shown are representative of a particular high pressure viscous gas flow of an available launcher tube. A higher pressure viscous gas flow while causing higher recoil forces, would also produce a compensating higher anti-recoil force on the launcher tube. Too, these curves would vary due to nozzle efficiency as the angle of the conical surface differs from the 18° illustrated.

From the above description it can be seen that there is provided in a missile launcher tube a means for reducing recoil utilizing the exhaust gases and which is simple and does not affect the outer envelope of the launcher tube.

While the invention has been illustrated and described by means of a single embodiment, it is to be understood that numerous changes and modifications may be made therein without departing from the spirit and scope of the invention which is defined in the appended claims.

What is claimed is:

1. In a missile launcher for filing self propelled missiles which generate an internal exhaust gas over pressure within said launcher upon firing, a recoil reducer comprising:

a single wall tubular housing having a forward end from which the missile exits upon firing and an after end from which missile exhaust gases are emitted, the wall of the housing having any inner cylindrical surface and an outer cylindrical surface, a truncated conical surface formed in the wall of the housing at its after end, and wherein the conical surface extends from the after end of the outer wall surface to the inner wall surface at an angle between 10 and 20 degrees with respect to the outer wall surface, thus forming an outwardly flared surface against which the missile exhaust gases impinge when exiting the housing.

2. A recoil reducer as recited in claim 1, wherein:

the conical surface extends from the after end of the outer wall surface to the inner wall surface at an angle of 18 degrees with respect to the outer wall surface.

* * * * *